US007413583B2

(12) United States Patent
Langer et al.

(10) Patent No.: US 7,413,583 B2
(45) **Date of Patent: *Aug. 19, 2008**

(54) EMULSIFIED FUELS AND ENGINE OIL SYNERGY

(75) Inventors: Deborah A. Langer, Chesterland, OH (US); Ewa A. Bardasz, Mentor, OH (US); William D. Abraham, South Euclid, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 412 days.

This patent is subject to a terminal disclaimer.

(21) Appl. No.: 10/646,982

(22) Filed: Aug. 22, 2003

(65) Prior Publication Data

US 2005/0039381 A1 Feb. 24, 2005

(51) Int. Cl.

| | |
|---|---|
| ***F02B 47/04*** | (2006.01) |
| ***F02B 47/00*** | (2006.01) |
| ***F02B 47/02*** | (2006.01) |
| ***C10L 1/32*** | (2006.01) |
| ***C10L 1/00*** | (2006.01) |

(52) U.S. Cl. ..... 44/301; 44/300; 44/302; 123/25 R; 123/25 C; 123/25 E

(58) Field of Classification Search ..... 44/301, 44/302, 300; 123/25 R, 25 C, 25 E, 25 A
See application file for complete search history.

(56) References Cited

U.S. PATENT DOCUMENTS

| | | | | |
|---|---|---|---|---|
| 2,619,330 | A | 11/1952 | Willems et al. | 259/96 |
| 2,858,200 | A | 10/1958 | Broughten | 44/57 |
| 3,499,632 | A | 3/1970 | Piros | 259/4 |
| 3,756,794 | A | 9/1973 | Ford | 44/51 |
| 3,818,876 | A | 6/1974 | Voogd | 123/25 R |
| 3,855,103 | A | 12/1974 | McLaren et al. | 204/306 |
| 3,876,391 | A | 4/1975 | McCoy et al. | 44/51 |
| 4,048,080 | A | 9/1977 | Lee et al. | 252/51.54 |
| 4,083,698 | A * | 4/1978 | Wenzel et al. | 44/301 |
| 4,084,940 | A | 4/1978 | Lissant | 44/51 |
| 4,146,499 | A | 3/1979 | Rosano | 252/186 |
| 4,207,078 | A | 6/1980 | Sweeney et al. | 44/68 |
| 4,329,249 | A | 5/1982 | Forsberg | 252/34.7 |
| 4,368,133 | A | 1/1983 | Forsberg | 252/75 |
| 4,433,917 | A | 2/1984 | Mendel et al. | 366/132 |
| 4,438,731 | A | 3/1984 | Maggio | 123/25 N |
| 4,447,348 | A | 5/1984 | Forsberg | 252/75 |
| 4,452,712 | A | 6/1984 | Laemmle | 252/49.3 |
| 4,482,356 | A | 11/1984 | Hanlon | 44/57 |
| 4,561,861 | A | 12/1985 | Davis et al. | 44/51 |
| 4,585,461 | A | 4/1986 | Gorman | 44/53 |
| 4,613,341 | A | 9/1986 | Zaweski et al. | 44/57 |
| 4,621,927 | A | 11/1986 | Hiroi | 366/132 |
| 4,629,472 | A | 12/1986 | Haney, III et al. | 44/51 |
| 4,697,929 | A | 10/1987 | Muller | 366/97 |
| 4,708,753 | A | 11/1987 | Forsberg | 149/2 |
| 4,776,977 | A | 10/1988 | Taylor | 252/314 |
| 4,846,985 | A * | 7/1989 | Rizvi et al. | 508/563 |
| 4,892,562 | A | 1/1990 | Bowers et al. | 44/67 |
| 4,907,368 | A | 3/1990 | Mullay et al. | 44/51 |
| 4,908,154 | A | 3/1990 | Cook et al. | 252/314 |
| 4,916,631 | A | 4/1990 | Crain et al. | 364/502 |
| 4,938,606 | A | 7/1990 | Kunz | 366/134 |
| 4,952,328 | A | 8/1990 | Davis et al. | 252/32.7 E |
| 4,953,097 | A | 8/1990 | Crain et al. | 364/502 |
| 4,983,319 | A | 1/1991 | Gregoli et al. | 252/314 |
| 4,986,858 | A | 1/1991 | Oliver et al. | 149/109.6 |
| 5,000,757 | A | 3/1991 | Puttock et al. | 44/301 |
| 5,047,175 | A | 9/1991 | Forsberg | 252/356 |
| 5,104,621 | A | 4/1992 | Pfost et al. | 422/67 |
| 5,279,626 | A | 1/1994 | Cunningham et al. | 44/331 |
| 5,352,377 | A | 10/1994 | Blain et al. | 252/51.5 R |
| 5,360,458 | A | 11/1994 | Forsberg et al. | 44/301 |
| 5,371,056 | A | 12/1994 | Leyrer et al. | 502/66 |
| 5,389,111 | A | 2/1995 | Nikanjam et al. | 44/300 |
| 5,389,112 | A | 2/1995 | Nikanjam et al. | 44/300 |
| 5,399,293 | A | 3/1995 | Nunez et al. | 252/314 |
| 5,404,841 | A | 4/1995 | Valentine | 123/25 E |
| 5,411,558 | A | 5/1995 | Taniguchi et al. | 44/301 |
| 5,445,656 | A | 8/1995 | Marelli | 44/301 |
| 5,452,577 | A | 9/1995 | Langer | 60/299 |

(Continued)

FOREIGN PATENT DOCUMENTS

AU 199722963 B2 10/1997

(Continued)

OTHER PUBLICATIONS

"Les Lubrifiants Synthetiques: Evolution de la Lubrification", Petrole et Techniques, Association Francaise des Techniciens du Petrole, Paris, FR, No. 371, Mar. 1, 1992, pp. 5-10, XP000268625, ISSN 0152-5425, p. 7.*

(Continued)

*Primary Examiner*—Sanza L McClendon
(74) *Attorney, Agent, or Firm*—Christopher D. Hilker; Teresan W. Gilbert

(57) ABSTRACT

The invention relates to the use of an emulsified fuel in combination with an engine oil that shows a synergistic effect in reducing emissions such as particulate matter, hydrocarbons and/or nitrogen oxides (NO, $NO_2$, $N_2O$, collectively NOx) and/or reducing wear from an engine.

19 Claims, No Drawings

U.S. PATENT DOCUMENTS

| | | | | |
|---|---|---|---|---|
| 5,462,907 | A | 10/1995 | Farrauto et al. | 502/304 |
| 5,478,365 | A | 12/1995 | Nikanjam et al. | 44/280 |
| 5,491,120 | A | 2/1996 | Voss et al. | 502/304 |
| 5,501,714 | A | 3/1996 | Valentine et al. | 44/358 |
| 5,503,772 | A | 4/1996 | Rivas et al. | 252/314 |
| 5,535,708 | A | 7/1996 | Valentine | 123/25 C |
| 5,544,856 | A | 8/1996 | King et al. | 251/129.08 |
| 5,556,574 | A | 9/1996 | Rivas et al. | 252/311.5 |
| 5,584,894 | A | 12/1996 | Peter-Hoblyn et al. | 44/301 |
| 5,595,964 | A | 1/1997 | Bardasz | 508/423 |
| 5,624,999 | A | 4/1997 | Lombardi et al. | 525/52 |
| 5,632,596 | A | 5/1997 | Ross | 415/83 |
| 5,643,528 | A | 7/1997 | Le Gras | 266/88 |
| 5,652,201 | A * | 7/1997 | Papay et al. | 508/228 |
| 5,669,938 | A | 9/1997 | Schwab | 44/301 |
| 5,682,842 | A | 11/1997 | Coleman et al. | 123/25 C |
| 5,693,106 | A | 12/1997 | Peter-Hoblyn et al. | 44/301 |
| 5,706,896 | A | 1/1998 | Tubel et al. | 166/313 |
| 5,707,942 | A * | 1/1998 | Arai et al. | 508/365 |
| 5,743,922 | A | 4/1998 | Peter-Hoblyn et al. | 44/301 |
| 5,746,783 | A | 5/1998 | Compere et al. | 44/301 |
| 5,792,223 | A | 8/1998 | Rivas et al. | 44/302 |
| 5,809,774 | A | 9/1998 | Peter-Hoblyn et al. | 60/274 |
| 5,809,775 | A | 9/1998 | Tarabulski et al. | 60/274 |
| 5,820,640 | A | 10/1998 | Ikura et al. | 44/301 |
| 5,851,245 | A | 12/1998 | Moriyama et al. | 44/301 |
| 5,863,301 | A | 1/1999 | Grosso et al. | 44/301 |
| 5,868,201 | A | 2/1999 | Bussear et al. | 166/53 |
| 5,873,916 | A | 2/1999 | Cemenska et al. | 44/301 |
| 5,879,079 | A | 3/1999 | Hohmann et al. | 366/151.1 |
| 5,879,419 | A | 3/1999 | Moriyama et al. | 44/301 |
| 5,924,280 | A | 7/1999 | Tarabulski | 60/274 |
| 5,976,475 | A | 11/1999 | Peter-Hoblyn et al. | 423/212 |
| 5,987,882 | A | 11/1999 | Voss et al. | 60/274 |
| 6,003,303 | A | 12/1999 | Peter-Hoblyn et al. | 60/274 |
| 6,006,516 | A | 12/1999 | Voss et al. | 60/299 |
| 6,051,040 | A | 4/2000 | Peter-Hoblyn | 44/358 |
| 6,068,670 | A | 5/2000 | Haupais et al. | 44/301 |
| 6,176,078 | B1 | 1/2001 | Balko et al. | 60/274 |
| 6,203,770 | B1 | 3/2001 | Peter-Hoblyn et al. | 423/212 |
| 6,211,253 | B1 * | 4/2001 | Marelli | 516/53 |
| 6,280,485 | B1 | 8/2001 | Daly et al. | 44/301 |
| 6,310,009 | B1 * | 10/2001 | Kocsis et al. | 508/186 |
| 6,583,092 | B1 * | 6/2003 | Carrick et al. | 508/198 |
| 6,596,672 | B1 | 7/2003 | Carrick et al. | 508/192 |
| 6,617,396 | B1 * | 9/2003 | Harrison et al. | 525/301 |
| 6,748,905 | B2 * | 6/2004 | Duncan et al. | 123/25 E |
| 7,018,962 | B2 * | 3/2006 | Bloch et al. | 508/591 |
| 2002/0017052 | A1 * | 2/2002 | Hori et al. | 44/301 |
| 2004/0111955 | A1 * | 6/2004 | Mullay et al. | 44/301 |
| 2004/0111957 | A1 * | 6/2004 | Filippini et al. | 44/351 |
| 2006/0162237 | A1 * | 7/2006 | Mullay et al. | 44/301 |
| 2006/0272597 | A1 * | 12/2006 | Burrington et al. | 123/1 A |

FOREIGN PATENT DOCUMENTS

| | | | |
|---|---|---|---|
| EP | 242832 | B * | 11/1991 |
| EP | 0475620 | A2 | 3/1992 |
| EP | 0561600 | B1 | 9/1993 |
| EP | 0888421 | B1 | 1/1999 |
| GB | 2117666 | A | 10/1983 |
| JP | 57055995 | A * | 4/1982 |
| WO | WO 97/34969 | | 3/1996 |
| WO | WO 96/28524 | | 9/1996 |
| WO | WO 99/13028 | | 3/1999 |
| WO | WO 99/13029 | | 3/1999 |
| WO | WO 99/13030 | | 3/1999 |
| WO | WO 99/13031 | | 3/1999 |
| WO | WO 99/54426 | | 10/1999 |
| WO | WO 00/15740 | | 3/2000 |
| WO | WO 01/97952 | | 12/2001 |
| WO | WO 02/24842 | | 3/2002 |
| WO | WO 02/24843 | | 3/2002 |
| WO | WO 02/26918 | | 4/2002 |
| WO | WO 02/064708 | | 8/2002 |
| WO | WO 02/068334 | | 9/2002 |
| WO | WO 02/079353 | A1 * | 10/2002 |
| WO | WO 03/064568 | | 8/2003 |
| WO | WO 03/076783 | | 9/2003 |
| WO | WO 03/083020 | A2 * | 10/2003 |

OTHER PUBLICATIONS

Search Report from corresponding PCT International Application No. PCT/US2004/026635 filed Aug. 17, 2004 (published as WO 2005/021691A2; International Publication Date: Mar. 10, 2005).

JP2000303875A Oct. 31, 2000, Sekiguchi KK and JP Abstract: Derwent Publications Ltd., London, GB; AN 2001-021875, XP002315970).

* cited by examiner

EMULSIFIED FUELS AND ENGINE OIL SYNERGY

This application is a continuation of U.S. Ser. No. 10/646,982 filed Aug. 22, 2003 and claims benefit of said prior application.

FIELD OF THE INVENTION

The invention relates to the use of an emulsified fuel in combination with an engine oil that shows a synergistic effect in reducing emissions such as particulate matter, hydrocarbons and/or nitrogen oxides (NO, $NO_2$, $N_2O$, collectively NOx) and/or reducing wear from an engine.

BACKGROUND OF THE INVENTION

Present and future engines need to meet upcoming emissions legislation. Governmental regulations and environmental concerns have driven the need to reduce emissions from internal combustion engines. In The United States of America the Clean Air Act will require 90% to 95% reduction of the current level of emissions from internal combustion engines by the year 2007. Similar regulations are expected in Europe and other parts of the industrialized world.

The reduction of NOx production conventionally includes the use of catalytic converters, "clean" fuels, exhaust gas recirculation, and engine timing changes. These methods are generally expensive or too complicated to be readily commercially available.

Fuel improvements have occurred through emulsified fuels. When water is added to a fuel it forms an emulsion. An emulsified fuel lowers peak combustion temperature due to the water and thus reduces particulates and NOx formation. Internal combustion engines, in particular diesel engines, using emulsified fuels results in the combustion chamber producing lower NOx, hydrocarbons and particulate matter emissions.

Another complication facing modern compression ignited and spark ignited engines is the build up of particulate matter in the lubricating oil. The buildup of soot thickens the lubricating oil and can cause engine deposits. When the soot levels gets too high, the increase in oil viscosity results in poor lubrication at critical wear points of the engine. This poor lubrication results in high wear, the formulation of higher amounts of piston deposits, a loss in fuel economy occurs and increased exhaust emissions. The net result is a shorter effective life of the lubricating oil and exhaust emissions.

The problem remains that further reductions in pollutants especially NOx, particulate matters and hydrocarbons are required from engine emissions. The instant invention provides a solution to these problems.

It is needed that the engine, lubricating engine oil and fuel need to be integrated into a system to maximize the reduction of engine emission.

It has been found that engine emissions are reduced by using an emulsified fuel in combination with any engine oil, either a conventional engine oil or an ashless non-conventional engine oil.

It has been found that the engine oil that is consumed and burned in the engine reduces a portion of the total particulate matter and the emulsified fuel reduces the other component of the particulate matter. Furthermore, the synergy results in the further reduction of hydrocarbons and NOx emissions from an engine. Additionally, the use of an ashless engine oil further adds limited wear protection to the engine and reduces emissions.

The use of an emulsified fuel with a suitably selected (low ash or no ash and/or low phosphorus) engine oil synergistically reduces the emissions from an engine.

SUMMARY OF THE INVENTION

The invention relates to a process for reducing the level of pollutants from engine emissions and/or decreasing engine wear comprising operating an engine using as the fuel a water fuel emulsion and using an engine oil such as an ashless non-conventional engine oil, a conventional engine oil or combinations thereof.

The water fuel emulsion is comprised of water, fuel and an emulsifier. The emulsifier comprises:

(i) at least one fuel-soluble product made by reacting at least one hydrocarbyl-substituted carboxylic acid acylating agent with ammonia or an amine including but not limited to alkanol amine, hydroxy amine, and the like, the hydrocarbyl substituent of said acylating agent having about 50 to about 500 carbon atoms;

(ii) a second (meaning another acylating agent than in (i)) acylating agent having at least one hydrocarbyl substituent of up to about 40 carbon atoms and reaching the acylating agent with ammonia or an amine, the hydrocarbyl substituent of said acylating agent having about 50 to about 500 carbon atoms;

(iii) at least one of an ionic or nonionic compound having a hydrophilic-lipophilic balance (HLB) of about 1 to about 40;

(iv) a mixture of (i) with (ii) or (iii);

(v) a water-soluble compound selected from the group consisting of amine salts, ammonium salts, azide compounds, nitrate esters, nitramine, nitro compounds, alkali metal salts, alkaline earth metal salts, in combination with (i), (ii), (iii), (iv), (vi) or (vii) or combinations therein;

(vi) the reaction product of polyacidic polymer with at least one fuel soluble product made by reacting at least one hydrocarbyl-substituted carboxylic acid acylating agent with ammonia, an amine, a polyamine, an alkanol amine or hydroxyl amines;

(vii) an amino alkylphenol which is made by reacting an alkylphenol; or (viii) any combination of (i), (ii), (iii), (iv), (v), (vi) and (vii).

It has been found that by using an emulsified fuel in combination with an ashless, low ash and/or low phosphorous non-conventional engine oil results in a synergistic effect that reduces emissions such as particulate matter, NOx and/or hydrocarbons from an engine.

The oil that is consumed and burned in an engine preferentially reduces one portion of the total particulate matter and the emulsified fuel reduces the other component that makes up the particulate matter. The combination of an engine using an emulsified fuel and ashless engine oil synergistically reduces both the soluble organic fraction and carbon core fraction of the particulate matter. Furthermore, the hydrocarbons and NOx are reduced in the engine emissions by the synergistic effect of using an emulsified fuel and ashless engine oil. Additionally, the use of an ashless engine oil when combined with an emulsified fuel offers low emission performance and limited wear protection.

DETAILED DESCRIPTION OF THE INVENTION

Fuel

The fuel comprises hydrocarbonaceous petroleum distillate fuel, non-hydrocarbonaceous materials that include but are not limited to water, oils, liquid fuels derived from vegetable sources, liquid fuels derived from minerals and mixtures thereof. Suitable fuels include, but are not limited to, gasoline, diesel, kerosene, naphtha, aliphatics and paraffin. The fuel comprises non-hydrocarbonaceous materials include but is not limited to alcohols such as methanol, ethanol and the like, ethers such as diethyl ether, methyl ethyl ether and the like, organo-nitro compounds and the like; fuels derived from vegetable or mineral sources such as corn, alfalfa, shale, coal and the like. The fuel also includes but is not limited to gas to liquid fuels. The fuel also includes but is not limited to mixtures of one or more hydrocarbonaceous fuels and one or more non-hydrocarbonaceous materials. Examples of such mixtures are combinations of gasoline and ethanol and of diesel fuel and ether and the like.

In one embodiment, the fuel is any gasoline. Including, but not limited to a chlorine-free gasoline or a low-chlorine gasoline, or a low sulfur gasoline or sulfur-free gasoline and the like.

In one embodiment, the fuel is any diesel fuel. The diesel fuels include, but are not limited to, those that contain alcohols and esters, have a sulfur content of up to about 0.05% by weight or are sulfur-free, chlorine-free or low-chlorine diesel fuel and the like.

The fuel is present in the emulsified fuel at a concentration of about 50% to about 95% by weight, and in one embodiment about 60% to about 95% by weight, and in one embodiment about 65% to about 85% by weight, and in one embodiment about 80% to about 90% by weight of the emulsified fuel.

Water

The water used in the emulsified fuel may be taken from any source. The water includes but is not limited to tap, deionized, de-ionized to a conductivity of <30 microsiemens/cm; up to 50% v/v, demineralized, purified, for example, using reverse osmosis or distillation, and the like. The water includes water mixtures that further includes but are not limited to antifreeze components such as alcohols and glycols, ammonium acetate and the like, and combinations thereof; and other water soluble additives.

The water is present in the emulsified fuel at a concentration of about 1% to about 50% by weight, in one embodiment about 5% to about 40% being weight, in one embodiment about 5% to about 25% by weight, and in one embodiment about 10% to about 20% by weight of the emulsified fuel.

In another embodiment the water is present in the emulsified fuel at a concentration of less than or equal to 1% by weight, in another embodiment less than or equal to 0.5% by weight, in another embodiment in the range of about 0.1% to about 1% by weight of the emulsified fuel. An emulsified water in fuel composition can be made with water at these low levels with a fuel, an emulsifier and optionally an ammonium nitrate.

Emulsifier

The emulsifier includes but is not limited to:

(i) at least one fuel-soluble product made by reacting at least one hydrocarbyl-substituted carboxylic acid acylating agent with ammonia or an amine including but not limited to alkanol amine, hydroxy amine, and the like, the hydrocarbyl substituent of said acylating agent having about 50 to about 500 carbon atoms;

(ii) a second (meaning another acylating agent than in (i)) acylating agent having at least one hydrocarbyl substituents of up to about 40 carbon atoms, and reacting that said acylating agent with ammonia or an amine;

(iii) at least one of an ionic or a nonionic compound having a hydrophilic-lipophilic balance (HLB) of about 1 to about 40;

(iv) mixture of (ii) or (iii) with (i);

(v) a water-soluble compound selected from the group consisting of amine salts, ammonium salts, azide compounds, nitrate esters, nitramine, nitrocompounds, alkali metal salts, alkaline earth metal salts, in combination with (i), (ii), (iii), (iv), (vi) or (vii) or combinations thereof;

(vi) the reaction product of polyacidic polymer with at least one fuel soluble product made by reacting at least one hydrocarbyl-substituted carboxylic acid acylating agent with ammonia, an amine, a polyamine, an alkanol amine or hydroxy amines;

(vii) an amino alkylphenol which is made by reacting an alkylphenol, an aldehyde and an amine resulting in an amino alkylphenol; or (viii) any combination of (i), (ii), (iii), (iv), (v), (vi), or (vii) thereof.

The fuel-soluble product (i) of the emulsifier may be at least one fuel-soluble product made by reacting at least one hydrocarbyl-substituted carboxylic acid acylating agent with ammonia or an amine including but not limited to alkanol amines, hydroxy amines, and the like, the hydrocarbyl substituent of said acylating agent having about 50 to about 500 carbon atoms, and is described in greater detail in U.S. Ser. No. 09/761,482, An Emulsifier For An Aqueous Hydrocarbon Fuel, incorporated by reference herein.

The hydrocarbyl-substituted carboxylic acid acylating agents may be carboxylic acids or reactive equivalents of such acids. The reactive equivalents may be acid halides, anhydrides, or esters, including partial esters and the like. The hydrocarbyl substituents for these carboxylic acid acylating agents may contain from about 50 to about 500 carbon atoms, and in one embodiment about 50 to about 300 carbon atoms, and in one embodiment about 60 to about 200 carbon atoms. In one embodiment, the hydrocarbyl substituents of these acylating agents have number average molecular weights of about 700 to about 3000, and in one embodiment about 900 to about 2300.

In another embodiment, the fuel soluble product (i) of the present invention comprises an emulsifying amount of at least one of a fuel-soluble hydrocarbyl-substituted carboxylic acylating agent and a reaction product of said acylating agent with at least one of ammonia, an amine, an alcohol, a reactive metal, a reactive metal compound or a mixture of two or more thereof, wherein the hydrocarbyl substituent comprises a group derived from at least one polyolefin, said polyolefin having $\overline{M}_w/\overline{M}_n$ greater than about 5.

The hydrocarbyl substituted acylating agents have a hydrocarbyl group substituent that is derived from a polyolefin, with polydispersity and other features as described below. Generally, it has a number average molecular weight of at least 600, 700, or 800, to 5000 or more, often up to 3000, 2500, 1600, 1300, or 1200. Typically, less than 5% by weight of the polyolefin molecules have $\overline{M}_n$ less than about 250, more often the polyolefin has $\overline{M}_n$ of at least about 800. The polyolefin preferably contains at least about 30% terminal vinylidene groups, more often at least about 60% and more preferably at least about 75% or about 85% terminal vinylidene groups. In one embodiment, the polyolefin has polydispersity, $\overline{M}_w/\overline{M}_n$, greater than about 5, more often from about 6 to about 20. The polyolefin polymer may be a polyisobutene, polypropylene, polyethylene, a copolymer derived from isobutene and butadiene, or a copolymer derived from isobutene and isoprene. The hydrocarbyl group is typically derived from a polyolefin or a polymerizable derivative thereof, including homopolymers and interpolymers of olefin monomers having 2 to 30, to 6, or to 4 carbon atoms, and mixtures thereof. In a preferred embodiment the polyolefin is polyisobutene.

Suitable olefin polymer hydrocarbyl groups, having suitable polydispersity, can be prepared by heteropolyacid catalyzed polymerization of olefins under conventional conditions. Preferred heteropolyacids include a phosphotungstic acid, a phosphomolybdic acid, a silicotungstic acid, a silicomolybdic acid and the like.

In one embodiment the polydispersity, $\overline{M}_w/\overline{M}_n$ is 3 to 5. A preferred catalyst for making such dispersity is $BF_3$ and the like.

The hydrocarbyl-substituted carboxylic acid acylating agents may be made by reacting one or more alpha-beta olefinically unsaturated carboxylic acid reagents containing 2 to about 20 carbon atoms, exclusive of the carboxyl groups, with one or more olefin polymers as described more fully hereinafter.

In one embodiment, the hydrocarbyl-substituted carboxylic acid acylating agent is a polyisobutene-substituted succinic anhydride, the polyisobutene substituent having a number average molecular weight of about 1,500 to about 3,000, in one embodiment about 1,800 to about 2,300, in one embodiment about 700 to about 1300, in one embodiment about 800 to about 1000, said first polyisobutene-substituted succinic anhydride being characterized by about 1.3 to about 2.5, and in one embodiment about 1.7 to about 2.1. In one embodiment, the hydrocarbyl-substituted carboxylic acid acylating agent is a polyisobutene-substituted succinic anhydride, the polyisobutene substituent having a number average molecular weight of about 1,500 to about 3,000, and in one embodiment about 1,800 to about 2,300, said first polyisobutene-substituted succinic anhydride being characterized by about 1.3 to about 2.5, and in one embodiment about 1.7 to about 2.1, in one embodiment about 1.0 to about 1.3, and in one embodiment about 1.0 to about 1.2 succinic groups per equivalent weight of the polyisobutene substituent.

The fuel-soluble product (i) may be formed using ammonia, an amine and/or the metal bases of metals such as Na, K, Ca, and the like. The amines useful for reacting with the acylating agent to form the product (i) including but are not limited to, monoamines, polyamines, alkanol amines, hydroxy amines, and mixtures thereof, and amines may be primary, secondary or tertiary amines.

Examples of primary and secondary monoamines include ethylamine, diethylamine, n-butylamine, di-n-butylamine, allylamine, isobutylamine, cocoamine, stearylamine, laurylamine, methyllaurylamine, oleylamine, N-methyloctylamine, dodecylamine, and octadecylamine. Suitable examples of tertiary monoamines include trimethylamine, triethylamine, tripropylamine, tributylamine, monoethyldimethylamine, methylpropylamine, dimethylbutylamine, dimethylpentylamine, dimethylhexylamine, dimethyl-heptylamine, and dimethyloctylamine.

The amines include but are not limited to hydroxyamines, such as mono-, di-, and triethanolamine, dimethyl ethanolamine, diethyl ethanolamine, di-(3-hydroxy propyl) amine, N-(2-hydroxybutyl) amine, N-(4-hydroxy butyl) amine, and N,N-di-(2-hydroxypropyl) amine; alkylene polyamines such as ethylene polyamines, butylene polyamines, propylene polyamines, pentylene polyamines, and the like. Specific examples of such polyamines include ethylene diamine, diethylene triamine, triethylene tetramine, propylene diamine, trimethylene diamine, tripropylene tetramine, tetraethylene pentamine, hexa-ethylene heptamine, pentaethylene hexamine, or a mixture of two or more thereof; ethylene polyamine bottoms or a heavy polyamine. The fuel-soluble product (i) may be a salt, an ester, an ester/salt, an amide, an imide, or a combination of two or more thereof.

The fuel-soluble product (i) may be present in the water fuel emulsion at a concentration of up to about 15% by weight based on the overall weight of the emulsion, and in one embodiment about 0.1 to about 15% by weight, and an one embodiment about 0.1 to about 10% by weight, and in one embodiment about 0.1 to about 5% by weight, and in one embodiment about 0.1 to about 2% by weight, and in one embodiment about 0.1 to about 1% by weight, and in one embodiment about 0.1 to about 0.7% by weight.

The second acylating agent (ii) of this invention includes carboxylic acids and their reactive equivalents such as acid halides and anhydrides.

In one embodiment, the carboxylic acid is a monocarboxylic acid of about 1 to about 35 carbon atoms, and in one embodiment about 16 to about 24 carbon atoms. Examples of these monocarboxylic acids include lauric acid, oleic acid, isostearic acid, palmitic acid, stearic acid, linoleic acid, arachidic acid, gadoleic acid, behenic acid, erucic acid, tall oil fatty acids, lignoceric acid and the like. These acids may be saturated, unsaturated, or have other functional groups, such as hydroxy groups, as in 12-hydroxy stearic acid, from the hydrocarbyl backbone.

In one embodiment, the carboxylic acid is a hydrocarbyl-substituted succinic acid represented correspondingly by the formula

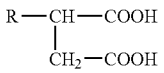

wherein formula R is a hydrocarbyl group of about 12 to about 35, and in one embodiment from about 12 to about 30, and in one embodiment from about 16 to about 24 and in one embodiment from about 26 to about 35 carbon atoms. The production of such hydrocarbyl-substituted succinic acids or anhydrides via alkylation of maleic acid or anhydride or its derivatives with a halohydrocarbon or via reaction of maleic acid or anhydride with an olefin polymer having a terminal double bond is known to those of skill in the art.

In one embodiment, the acylating agent (ii) is a carboxylic acid or the acylating agent (ii) used to prepare carboxylic acid and is made by reacting one or more alpha-beta olefinically unsaturated carboxylic acid reagents containing about 2 to about 20 carbon atoms, exclusive of the carboxyl based groups, with one or more olefin polymers containing at least about 16 carbon atoms.

In the one embodiment, the ratio of the emulsifier from acylating agent (i), to the emulsifier from acylating agent (ii) in the emulsified fuel is in the range of about 9:1 to about 1:9; in another embodiment in the range of about 5:1 to about 1:5; and in another embodiment in the range of about 1:3 to about 3.1.

The ionic or nonionic compound (iii) of the emulsifier has a hydrophilic-lipophilic balance (HLB, which refers to the size and strength of the polar (hydrophilic) and non-polar (lipophilic) groups on the surfactant molecule) in the range of about 1 to about 40, and in one embodiment about 4 to about 15 and is described in greater detail in U.S. Ser. No. 09/761, 482, An Emulsifier For An Aqueous Hydrocarbon Fuel, incorporated by reference herein. Examples of these compounds are disclosed in *McCutcheon's Emulsifiers and Detergents,* 1998, North American & International Edition. Pages 1-235 of the North American Edition and pages 1-199 of the International Edition are incorporated herein by reference for their disclosure of such ionic and nonionic compounds having an HLB in the range of about 1 to about 40, in one embodiment about 1 to about 30, in one embodiment about 1 to 20, and in another embodiment about 1 to about 10. Examples include low molecular weight variants of (i) or (vii) such as those having a hydrocarbon group in the range of $C_8$ or $C_{20}$. Useful compounds include alkanolamines, carboxylates including amine salts, metallic salts and the like, alkylarylsulfonates, amine oxides, poly(oxyalkylene) compounds, including block copolymers comprising alkylene oxide repeat units, carboxylated alcohol ethoxylates, ethoxylated alcohols, ethoxylated alkylphenols, ethoxylated amines and amides, ethoxylated fatty acids, ethoxylated fatty esters and oils, fatty esters, fatty acid amides, including but not limited to amides from tall oil fatty acids and polyamides, glycerol esters, glycol esters, sorbitan esters, imidazoline derivatives, lecithin and derivatives, lignin and derivatives, monoglycerides and derivatives, olefin sulfonates, phosphate esters and derivatives, propoxylated and ethoxylated fatty acids or alcohols or alkylphenols, sorbitan derivatives, sucrose esters and derivatives, sulfates or alcohols or ethoxylated alcohols or fatty esters, sulfonates of dodecyl and tridecyl benzenes or condensed naphthalenes or petroleum, sulfosuccinates and derivatives, and tridecyl and dodecyl benzene sulfonic acids.

The emulsifier (iv) may be a mixture of (i) and (ii) described above and is further described in detail in U.S. Ser. No. 09/761,482, An Emulsifier For An Aqueous Hydrocarbon Fuel, incorporated by reference herein.

The water-soluble compound (v) may be an amine salt, ammonium salt, azide compound, nitro compound, alkali metal salt, alkaline earth metal salt, or mixtures of two or more thereof and is described in greater detail in U.S. Ser. No. 09/761,482, An Emulsifier For An Aqueous Hydrocarbon Fuel, incorporated by reference herein. These compounds are distinct from the fuel-soluble product (i) and the ionic or nonionic compound (ii) discussed above. These water-soluble compounds include organic amine nitrates, nitrate esters, azides, nitramines and nitro compounds. Also included are alkali and alkaline earth metal carbonates, sulfates, sulfides, sulfonates, and the like.

Particularly useful are the amine or ammonium salts such as ammonium nitrate, ammonium acetate, methylammonium nitrate, methylammonium acetate, hydroxy ammonium nitrate, ethylene diamine diacetate; urea nitrate; urea; guanidinium nitrate; and combinations thereof. However, these ammonium salts of the emulsifier, if used are independent of and distinct and separate from the aqueous organic ammonium salt compound of the emulsified fuel discussed above.

In one embodiment the emulsifier (vi) is the reaction product of A) a polyacidic polymer, B) at least one fuel soluble product made by reacting at least one hydrocarbyl-substituted carboxylic acid acylating agent, and C) a hydroxy amine and/or a polyamine and is described in greater detail in U.S. Ser. No. 09/761,482, An Emulsifier For An Aqueous Hydrocarbon Fuel, incorporated by reference herein.

The polyacidic polymers used in the reaction include but are not limited to $C_4$ to $C_{30}$; preferably $C_8$ to $C_{20}$ olefin/maleic anhydride copolymers; maleic anhydride/styrene copolymers; poly-maleic anhydride; acrylic and methacrylic acid containing polymers; poly-(alkyl)acrylates; reaction products of maleic anhydride with polymers with multiple double bonds;

A copolymer of an olefin and a monomer having the structure:

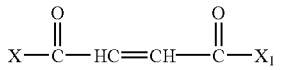

wherein X and X1 are the same or different provided that at least one of X and $X_1$ is such that the copolymer can function as a carboxylic acylating agent; and combinations therein.

The emulsifier produced from the reaction product of the polyacidic polymer with the fuel soluble product (i) comprises about 25% to about 95% of fuel soluble product and about 0.1% to about 50% of the polyacidic polymer; preferably about 50% to about 92% fuel soluble product and about 1% to about 20% of the polyacidic polymer, and most preferably about 70% to about 90% of fuel soluble product and about 5% to about 10% of the polyacidic polymer. In one embodiment the emulsifier is described as a polyalkenyl succinimide crosslinked with an olefin/maleic anhydride copolymer.

The amino alkylphenol emulsifier (vii) is comprised of the reaction product of an alkylphenol, an aldehyde, and an amine resulting in amino alkylphenol. The amino alkylphenol can be made by (a) the reaction of alkylphenol directly with an aldehyde and an amine resulting in an alkylphenol monomer connected by a methylene group to an amine, (b) the reaction of an alkylphenol with an aldehyde resulting in an oligomer wherein the alkylphenols are bridged with methylene groups, the oligomer is then reacted with more aldehyde and an amine to give a Mannich product, or (c) a mixture of (a) and (b) and is described in greater detail in U.S. Ser. No. 09/977,747 entitled A Continuous Process For Making An Aqueous Hydrocarbon Fuel Emulsion incorporated by reference herein.

The alkylphenols have an alkyl group selected from $C_6$ to $C_{200}$, preferably $C_6$ to $C_{170}$ wherein the alkyl group is either linear, branched or a combination thereof. The alkylphenols include, but are not limited to, polypropylphenol, polybutylphenol, poly(isobutenyl)phenol, polyamylphenol, tetrapropylphenol, similarly substituted phenols and the like. The preferred alkylphenols are tetrapropenylphenol and poly (isobutenyl)phenol.

The aldehydes include, but are not limited to, aliphatic aldehydes, such as formaldehyde; acetaldehyde; aldol (β-hydroxy butyraldehyde); aromatic aldehydes, such as benzaldehyde; heterocyclic aldehydes, such as furfural, and the like. The aldehyde may contain a substituent group such as hydroxyl, halogen, nitro and the like; in which the substituent does not take a major part in the reaction. The preferred aldehyde is formaldehyde.

The amines are those which contain an amino group characterized by the presence of at least one active hydrogen atom. The amines may be primary amino groups, secondary amino groups, or combinations of primary and secondary amino groups.

The amines include, but are not limited to, alkanolamines; di- and polyamine (polyalkyene amines); polyalkyl polyamines; propylenediamine, the aromatic amines such as o-, m- and p-phenylene diamine, diamino naphthalenes; the acid-substituted polyalkylpolyamines, and the corresponding formyl-, propionyl-, butyryl-, and the like N-substituted compounds; and the corresponding cyclized compounds formed therefrom, such as the N-alkyl amines of imidazolidine and pyrimidine. Substituent groups attached to the carbon atoms of these amines are typified by alkyl, aryl, alkaryl, aralkyl, cycloalkyl, and amino compounds. The amino alkylphenols emulsifier of this invention may be made by reacting the alkylphenol:aldehyde:amine in a ratio range of 1:1:0.1 molar to 1:2:2 molar, in one embodiment preferably 1:0.9:0.1 to 1:1.9:1.9, in one embodiment preferably 1:1.5:1.2 molar to 1:1.9:1.8 molar, and in one embodiment preferably 1:0.8:0.3 to 1:1.5:0.7, resulting in the amino alkylphenol emulsifier.

In another embodiment of this invention the amino alkylphenol is made by the reaction of an alkylphenol with an aldehyde, resulting in an oligomer wherein the alkylphenols are bridged with methylene groups; then the oligomer is reacted with more aldehyde and amine to give the emulsifier Mannich product of this invention. The reaction is prepared by any known method such as an emulsion, a solution, a suspension, and a continuous addition bulk process. The reaction is carried out under conditions that provide for the formation of the desired product.

The emulsifier is present in the emulsified fuel at a concentration of about 0.001% to about 20% by weight, in another embodiment about 0.05% to about 10% by weight, in another embodiment about 0.1% to about 5% by weight, and in a further embodiment of about 0.01% to about 3% by weight of the emulsified fuel. Combinations of emulsifiers may be used.

Cetane Improvers

In one embodiment, the emulsified fuel contains a cetane improver. The cetane improvers that are useful include but are not limited to peroxides, nitrates, nitrites, nitrocarbamates, and the like. Useful cetane improvers include but are not limited to nitropropane, dinitropropane, tetranitromethane, 2-nitro-2-methyl-1-butanol, 2-methyl-2-nitro-1-propanol, and the like. Also included are nitrate esters of substituted or unsubstituted aliphatic or cycloaliphatic alcohols which may be monohydric or polyhydric. These include substituted and unsubstituted alkyl or cycloalkyl nitrates having up to about 10 carbon atoms, and in one embodiment about 2 to about 10 carbon atoms. The alkyl group may be either linear or branched, or a mixture of linear or branched alkyl groups. Examples include methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, n-octyl nitrate, 2-ethylhexyl nitrate, sec-octyl nitrate, n-nonyl nitrate, n-decyl nitrate, cyclopentyl nitrate, cyclohexyl nitrate, methylcyclohexyl nitrate, and isopropylcyclohexyl nitrate. Also useful are the nitrate esters of alkoxy-substituted aliphatic alcohols such as 2-ethoxyethyl nitrate, 2-(2-ethoxy-ethoxy) ethyl nitrate, 1-methoxypropyl-2-nitrate, 4-ethoxybutyl nitrate, etc., as well as diol nitrates such as 1,6-hexamethylene dinitrate. A useful cetane improver is 2-ethylhexyl nitrate.

The concentration of the cetane improver in the emulsified fuel is at any concentration sufficient to provide the emulsion with the desired cetane number. In one embodiment, the concentration of the cetane improver is at a level of up to about 10% by weight, and in one embodiment about 0.05% to about 10% by weight, and in one embodiment about 0.05% to about 5% by weight, and in one embodiment about 0.05% to about 1% by weight of the emulsified fuel.

Combustion Improvers

The combustion improvers include strained ring compounds, nitro compounds, and certain hydroxyamines. Strained ring compounds are compounds containing cyclic rings of 3 to 5 atoms, and in one embodiment 3 to 4 atoms. The strained rings are typically saturated, but the 3 and 4 membered rings may contain olefinic unsaturation. The 5 membered rings do not contain olefinic unsaturation. The strained ring compounds may be monocyclic or polycyclic compounds. The polycyclic compounds may have fused ring systems, and/or ring systems connected directly of via a bridge group, and/or spiro-compounds. The polycyclic compounds may have, for example, from 2 to 4 rings. The rings may contain one or more heteroatoms (e.g., O, S, or N). Typically the heterocyclic rings contains at least 2 carbon atoms and no more than 2 heteroatoms, (e.g. O, S, or N), often but one heteroatom. Examples of useful strained ring compounds include cyclopropyl methanol, cyclobutyl amine, cyclobutyl hydroxydioxolane and 2,5-dimethoxytetra-hydrofuran.

The nitro compounds may be aliphatic or aromatic. They may contain one or more than one nitro group. The nitro compounds include purely hydrocarbon and substituted hydrocarbon compounds. Examples include nitromethane, nitropropane, dinitropropane, hydroxymethyl nitropropane, 1,3-dimorpholino-2-nitropropane, 1,2-dinitropropane, 2-methyl-2-nitropropane, bis(2-nitropropyl)methane, tetranitromethane, nitrobenzene, dinitrotolune, trinitrotoluene, and nitrated phenols (e.g., butyl-dinitrophenol).

The hydroxyamines useful as combustion improvers may be represented by the formulae

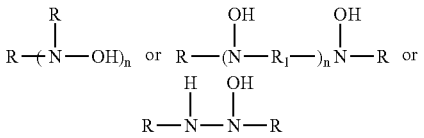

wherein each R is independently hydrogen or a hydrocarbyl group, R is an alkylene group, and n is a number ranging from 1 to about 30. These types of hydroxyamines wherein the hydroxyl group is attached directly to the nitrogen are also known as hydroxylamines. Each R may be a primary or secondary hydrocarbyl group. Each R group may contain from 1 to about 25 carbon atoms, and in one embodiment 1 to about 8 carbon atoms. $R^1$ may be lower alkylene group, and in embodiment it is ethylene or a propylene group. n may range from 1 to about 10, and in one embodiment 1 to about 5. Salts of these hydroxyamines may also be used. The salts include nitrates, sulfates, sulfonates, carbonates and carboxylates. Examples of these hydroxyamines are disclosed in U.S. Pat. Nos. 3,491,151; 4,017,512; 5,731,462; 5,733,935; and 6,031,130, incorporated herein by reference.

The concentration of the combustion improver in the emulsified fuel composition may range up to about 5% by weight, and in one embodiment about 0.005 to about 2% by weight.

The emulsified fuel may additionally contain an antifreeze agent. The antifreeze agent is typically an alcohol. Examples include but are not limited to ethylene glycol, propylene glycol, methanol, ethanol, glycerol and mixtures of two or more thereof. The antifreeze agent is typically used at a concentration sufficient to prevent freezing of the water used in the water fuel emulsion. The concentration is therefore dependent upon the temperature at which the fuel is stored or used. In one embodiment, the concentration is at a level of up to about 20% by weight of the emulsified fuel, and in one embodiment about 0.1% to about 20% by weight, and in one embodiment about 1% to about 10% by weight of the emulsified fuel.

Other Fu I Additives

In addition to the foregoing, other fuel additives that are well known to those of skill in the art may be used. These include antiknock agents, lead scavengers, ashless dispersants, deposit preventers or modifiers, dyes, antioxidants, rust inhibitors, bacteriostatic agents, gum inhibitors, metal deactivators, demulsifiers, upper cylinder lubricants, and the like.

The total concentration of the additives, in the emulsified fuel is from about 0.05% to about 30% by weight, and in one embodiment about 0.1% to about 20% by weight, and in one embodiment about 0.1% to about 15% by weight, and in one embodiment about 0.1% to about 10% by weight, and in one embodiment about 0.1% to about 5% by weight of the emulsified fuel.

Solvent

The oil-soluble fuel additives (e.g., cetane improvers, dispersants, deposit preventers or modifiers, etc.), as well as the emulsifier may be diluted with a substantially inert, normally liquid organic solvent such as mineral oil, kerosene, diesel fuel, synthetic oil (e.g., ester of dicarboxylic acid), naphtha, alkylated (e.g., $C_{10}$-$C_{13}$ alkyl) benzene, toluene or xylene to form an additive concentrate which is then mixed with the normally liquid hydrocarbon fuel and water.

The emulsified fuel may contain up to about 80% by weight organic solvent, and in one embodiment about 0.01% to about 50% by weight, and in one embodiment about 0.01% to about 20% by weight, and in one embodiment about 0.1% to about 5% by weight, and in one embodiment about 0.1% to about 3% by weight of the emulsified fuel. The emulsified fuel composition may contain up to about 10% by weight organic solvent, and in one embodiment about 0.01 to about 5% by weight.

Process

The emulsified fuel may be prepared by the steps of mixing the fuel, at least one emulsifier and other desired additives using standard mixing techniques to form a fuel additives mixture; and then the fuel additives mixture is mixed with water and optionally an antifreeze agent and/or soluble additives under emulsification conditions to form the desired emulsified fuel. Alternatively, a concentrate is formed in that all or substantially all the water, and a portion of the fuel, and all or substantially all the emulsifier is blended to form a concentrate of the emulsified fuel. The emulsified fuel, when used, is then blended with the rest of the fuel. Other water-soluble and hydrocarbon-soluble additives may be added to the concentrate, the final emulsified fuel or combinations thereof.

In the practice of the present invention the emulsified fuel is made by a batch, semi-batch or a continuous process. The process is capable of monitoring and adjusting the flow rates of the fuel, emulsifier(s), other additives and/or water to form a stable emulsion with the desired water droplet size.

The emulsified fuel may be prepared by the steps of mixing the fuel, the emulsifier, and other oil soluble additives using shear techniques to form the fuel additive mixture. Then the fuel additive mixture is mixed with water and optionally any desired water soluble additives to form the desired emulsified fuel.

In a batch process the water, the emulsifier(s), the fuel and optional additives are added to a tank, in the desired amounts. The mixture is emulsified using an emulsification device in the vessel, or alternatively the mixture flows from the vessel via a circular line to the emulsification device which is external to the vessel, for about 1 to about 20 tank turnovers. The temperature in the range of about ambient temperature to about 100° C. (212° F.), and in another embodiment in the range of about 4° C. (40° F.) to about 65° C. (150° F.), and at a pressure in the range of about atmospheric pressure to about 80 psi, in another embodiment in the range of about 1 to about 2 atm (15 psi to about 30 psi).

The continuous process described herein depicts another embodiment of the invention. The feeds of the fuel, emulsifier(s), water and optional additives are introduced as discrete feeds or in the alternative combinations of the discreet feeds. The processing streams are introduced in or as close to the inlet of the emulsification device as possible. It is preferable that the emulsifier is added to the fuel as a fuel emulsifier stream prior to the discreet feeds combining together. The continuous process generally occurs under ambient conditions. The continuous process generally occurs at atmosphere pressure to about 35 atm (500 psi), in another embodiment in the range of about atmospheric pressure to about 8 to 9 atm (about 120 psi), and in another embodiment in the range of about atmospheric pressure to about 4 atm (about 50 psi). The continuous process generally occurs at ambient temperature. In one embodiment the temperature is in the range of about ambient temperature to about 212° F., and in another embodiment in the range of about 4° C. (40° F.) to about 65° C. (150° F.).

Alternatively, a concentrate is formed and all or substantially all the water, and water soluble additive and a portion of the fuel and all or substantially all the emulsifiers and oil soluble additives as emulsified under shear conditions to form a concentrate fuel. The emulsified fuel, when used, is then blended under normal mixing conditions with the remaining portion of the fuel.

The emulsification may occur at shear conditions that are greater than 50,000 $s^{-1}$. However, the composition may be emulsified at shear process conditions and occurs at a shear rate in the range of less than or equal to 50,000 $s^{-1}$, and in another embodiment less the about 20,000 $s^{-1}$, and in another embodiment less the about 1,000 $s^{-1}$, and in another embodiment less than 100 $s^{-1}$, and in another embodiment less than 1 $s^{-1}$. If more than one emulsification step is used, the shear rates of the emulsification steps can be the same, similar or different, depending on the emulsifier and low molecular weight surfactant used. The emulsification provides for the desired particle size and a uniform dispersion of water in the fuel.

The emulsification occurs by any shear method used in the industry including but not limited to mixing, mechanical mixer agitation, static mixers, centrifugal pumps, positive displacement pumps, orifice plates, and the like. Examples of the devices include but are not limited to an Aquashear, pipeline static mixers, rotor/stator mixers and the like. The Aquashear is a low-pressure hydraulic shear device. The Aquashear mixers are available from Flow Process Technologies, Inc.

The process may be in the form of a containerized equipment unit that operates automatically. The process can be programmed and monitored locally at the site of its installation, or it can be programmed and monitored from a location remote from the site of its installation. The fully formulated emulsified fuel is optionally dispensed to end users at the installation site, or in another embodiment end users can blend the concentrated emulsion with the final portion of fuel. This provides a way to make the water in fuel emulsions available to end users in wide distribution networks.

The water phase of the emulsified fuel is comprised of droplets having a mean diameter of about 1.0 microns or less, in another embodiment about 0.8 microns or less, in another embodiment about 0.5 microns or less, in another embodiment about 0.15 microns or more, in another embodiment about 1.0 micron to about 0.5 microns, and in another embodiment about 1.0 micron to about 0.2 microns.

Oil of Lubricating Viscosity

The major component of the engine oil is an oil of lubricating viscosity, including natural and synthetic lubricating oils and mixtures thereof. Natural oils include animals oils, vegetable oils, mineral lubricating oils of paraffinic, naphthenic, or mixed types, solvent or acid treated mineral oils, and oils derived from coal or shale. Synthetic lubricating oils included hydrocarbon oils, halo-substituted hydrocarbon oils, alkylene oxide polymers (including those made by polymerization of ethylene oxide or propylene oxide), esters of dicarboxylic acids and variety of alcohols including polyols, esters of monocarboxylic acids and polyols, esters of phosphorus-containing acids, polymeric tetrahydrofurans, and silicon-based oils (including siloxane oils and silicate oils). Included are unrefined, refined, and rerefined oils. Specific examples of the oils of lubricating viscosity are described in U.S. Pat. No. 4,326,972.

Oils of lubricating viscosity can also be defined as specified in the American Petroleum Institute (API) Base Oil Interchangeability Guidelines. The five base oil groups are as follows:

| Base Oil Category | Sulphur (%) | | Saturates (%) | Viscosity Index |
|---|---|---|---|---|
| Group I | >0.03 | and/or | <90 | 80-120 |
| Group II | ≦0.03 | and | ≧90 | 80-120 |
| Group III | ≦0.03 | and | ≧90 | ≧120 |
| Group IV | All polyalphaolefins (PAOs) | | | |
| Group V | All others not included in Groups I, II, III, or IV | | | |

Groups I, II, and II are mineral oil base stocks. In one embodiment, the oil of lubricating viscosity in the present invention comprises a Group II, III, IV, or V oil or mixtures thereof. That is, a major portion of the oil can be of group II through V, optionally mixed with a minor portion of Group I oil.

The lubricating oil in the invention will normally comprise the major amount of the engine oil. Thus it will normally be at least 50% by weight, preferably about 83 to about 98%, and most preferably about 88 to about 90% of the engine oil. As an alternative embodiment, however, the present invention can provide an additive concentrate in which the oil can be greater than 0 to about 20% by weight, preferably about 1 to about 10%, and the other components, described in greater detail below, are proportionately increased.

Lubricant Additive

The additives for a conventional engine oil are typically a detergent, a dispersant, zinc dialkyldithiophosphates and other lubricant additives. The ashless engine oils are characterized by little or no sulfated ash producing components and typically include a dispersant and an antioxidant.

Dispersants are well known in the field of lubricants and include primarily what is known as ashless-type dispersants and polymeric dispersants. The dispersants include but are not limited to dispersants, polymeric dispersants, Mannich dispersants, high molecular weight (Cn wherein n≧40) esters, carboxylic dispersants, amine dispersants, amine dispersants, polymeric dispersants and combinations thereof the dispersant may be used alone or in combination. The dispersant is present in the range from about 0.1% to about 95% of the composition, preferably from about 1% to about 70% of the composition, and preferably from about 7% to about 50% of the lubricant composition.

The dispersant includes a polyisobutenyl succinimide and the like. Polyisobutenyl succinimide ashless dispersants are commercially-available products which are typically made by reacting together polyisobutylene having a number average molecular weight ($\overline{M}_n$) of about 300 to 10,000 with maleic anhydride to form polyisobutenyl succinic anhydride (PIBSA) and then reacting the product so obtained with a polyamine typically containing 1 to 10 ethylene diamine groups per molecule.

Ashless type dispersants are characterized by a polar group attached to a relatively high molecular weight hydrocarbon chain. Typical ashless dispersants include N-substituted long chain alkenyl succinimides, having a variety of chemical structures including typically:

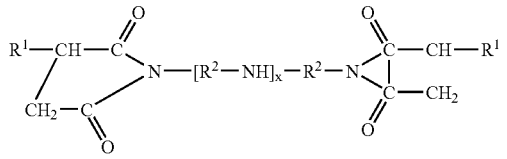

where each $R^1$ is independently an alkyl group, frequently a polyisobutyl group with a molecular weight of 500-5000, and $R^2$ are alkenyl groups, commonly ethylenyl ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. No. 4,234,435.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Carboxylic dispersants are reaction products of carboxylic acylating agents (acids, anhydrides, esters, etc.) containing at least about 34 and preferably at least about 54 carbon atoms are reacted with nitrogen containing compounds (such as amines), organic hydroxyl compounds (such as aliphatic compounds including monohydric and polyhydric alcohols, or aromatic compounds including phenols and naphthols), and/or basis inorganic materials. These reaction products include imide, acids generally contain from about 8 up to about 30, or from about 12 up to about 24 carbon atoms.

Amine dispersants are reaction products of relatively high molecular weight aliphatic halides and amines, preferably polyalkylene polyamines. Examples thereof are described, in U.S. Pat. Nos. 3,275,554 and 3,565,804.

Mannich dispersants are the reaction products of alkyl phenols in which the alkyl group contains at least about 30 carbon atoms with aldehydes (especially formaldehyde) and amines (especially polyalkylene polyamines). The materials described in the following U.S. Patents are illustrative: Nos. 3,036,003, 3,236,770, and 3,980,569.

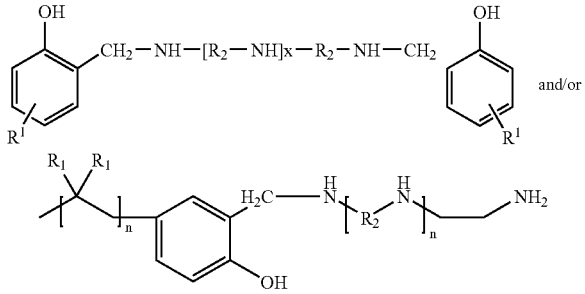

The above identified structure has n equal to zero to ten.

Polymeric dispersants are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acry-lates. Examples of polymer dispersants thereof are disclosed in U.S. Pat. Nos. 3,329,658 and 3,702,300.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitrites, epoxides, boron compounds, and phosphorus compounds. References detailing such treatment are listed in U.S. Pat. No. 4,654,403.

Detergents

The detergents include but are not limited to overbased sulfonates, phenates, salicylates, carboxylates, overbased calcium sulfonate detergents which are commercially-available, overbased detergents containing metals such as Mg, Ba, Sr, Na, Ca and K and mixtures thereof and the like. The detergents may be used alone or in combination. Detergents are described, for example, in U.S. Pat. No. 5,484,542 which is incorporated herein by reference. The detergents when used are typically present in the range from about 0.1% to about 5%, preferably from about 0.2% to about 3% and more preferably from about 0.3% to about 1% by weight of the lubricant composition. For a low ash to no ash engine oil the detergents, in particular the over based detergents are not employed or a minor amount are in the engine oil composition. For low ash there is generally about <1%, in another embodiment <0.8%, in another embodiment <0.5% and in another embodiment <0.2% of sulfated ash in the engine oil.

Antioxidants

Antioxidants include but are not limited to alkyl-substituted phenols such as 2,6-di-tertiary butyl-4-methyl phenol, phenate sulfides, phosphosulfurized terpenes, sulfurized esters, sulfurized olefins, aromatic amines, diphenyl amines, alkylated diphenyl amines and hindered phenols.

The antioxidant includes amine antioxidants and is not limited to bis-nonylated diphenylamine, nonyl diphenylamine,. octyl diphenylamine, bis-octylated diphenylamine, bis-decylated diphenylamine, decyl diphenylamine and mixtures thereof.

The antioxidant includes sterically hindered phenols and includes but is not limited to 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol 2,6-di-tert-butylphenol, 4-pentyl-2,6-di-tert-butylphenol, 4-hexyl-2,6-di-tert-butylphenol, 4-heptyl-2,6-di-tert-butylphenol, 4-(2-ethylhexyl)-2,6-di-tert-butylphenol, 4-octyl-2,6-di-tert-butylphenol, 4-nonyl-2,6-di-tert-butylphenol, 4-decyl-2,6-di-tert-butylphenol, 4-undecyl-2,6-di-tert-butylphenol, 4-dodecyl-2,6-di-tert-butylphenol, 4-tridecyl-2,6-di-tert-butylphenol, 4-tetradecyl-2,6-di-tert-butylphenol, methylene-bridged sterically hindered phenols include but are not limited to 4,4'-methylenebis(6-tert-butyl-o-cresol), 4,4'-methylenebis(2-tert-amyl-o-cresol), 2,2'-methylenebis(4-methyl-6-tert-butylphenol), 4,4'-methylene-bis (2,6-di-tertbutylphenol) 3,5-di-tert-butyl-4-hydroxy hydrocinnamic acid (iso-octyl ester butyl ester) and mixtures thereof.

Another example of an antioxidant is a hindered, ester-substituted phenol, which can be prepared by heating a 2,6-dialkylphenol with an acrylate ester under base catalysis conditions, such as aqueous KOH. Antioxidants may be used alone or in combination.

The antioxidants are typically present in the range of about 0.01% to about 10%, preferably about 0.1% to 7%, and more preferably about 0.2% to about 6% and most preferably about 0.3% to about 5% by weight of the lubricant composition.

Other Lubricant Additives

Extreme pressure and/or anti-wear additives ("EP Agent") include but are not limited to a sulfur or chlorosulphur EP agent, a chlorinated hydrocarbon EP agent, or a phosphorus EP agent, or mixtures thereof. Examples of such EP agents are chlorinated wax, organic sulfides and polysulfides, such as benzyldisulfide, bis-(chlorobenzyl) disulfide, dibutyl tetrasulfide, sulfurized sperm oil, sulfurized methyl ester of oleic acid sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbyl and trihydrocarbyl phosphate, i.e., dibutyl phosphate, diheptyl phosphate, dicyclohexyl phosphate, pentylphenyl phosphate; dipentylphenyl phosphate, tridecyl phosphate, distearyl phosphate and polypropylene substituted phenol phosphate, metal thiocarbamates, such as zinc dioctyldithiocarbamate and barium heptylphenol diacid, such as zinc dicyclohexyl phosphorodithioate and the zinc salts of a phosphorodithioic acid combination may be used and mixtures thereof. The EP agent can be used alone or in combination.

The EP agents are present in the range of about 0% to 10%, preferably from about 0.1% to about 5% and more preferably from about 0.2% to about 1.5% by weight of the lubricant composition.

Antifoams include but are not limited to organic silicones such as poly dimethyl siloxane, poly ethyl siloxane, poly diethyl siloxane and the like. The antifoams may be used alone or in combination.

The antifoams are normally used in the range of about 0% to about 0.05%, preferably about 0.001% to about 0.025% and more preferably 0.002% to about 0.02% by weight of the lubricant composition.

Viscosity modifiers provide both viscosity improving properties and dispersant properties. Examples of dispersant-viscosity modifiers include but are not limited to vinyl pyridine, N-vinyl pyrrolidone and N,N'-dimethylaminoethyl methacrylate are examples of nitrogen-containing monomers and the like. Polyacrylates obtained from the polymerization or copolymerization of one or more alkyl acrylates also are useful as viscosity modifiers. The viscosity modifiers may be used alone or in combination.

Functionalized polymers can also be used as viscosity modifiers. Among the common classes of such polymers are olefin copolymers and acrylate or methacrylate copolymers. Functionalized olefin copolymers can be, for instance, interpolymers of ethylene and propylene which are grafted with an active monomer such as maleic anhydride and then derivatized with an alcohol or an amine. Other such copolymers are copolymers of ethylene and propylene which are reacted or grafted with nitrogen compounds. Derivatives of polyacrylate esters are well known as dispersant viscosity index modifiers additives. Dispersant acrylate or polymethacrylate viscosity modifiers such as Acryloid™ 985 or Viscoplex™ 6-054, from RohMax, are particularly useful. Solid, oil-soluble polymers such as the PIB, methacrylate, polyalkylstyrene, ethylene/propylene and ethylene/propyl-ene/1,4-hexadiene polymers, can also be used as viscosity index improvers.

The viscosity modifiers are known and commercially available. The viscosity modifiers are present in the range of about 0% to about 10%, preferably about 0.2% to about 7% and more preferably about 0.4% to about 5% of the lubricant composition.

The lubricant may additionally contain a friction modifier. Useful friction modifiers include fatty amines, esters, especially glycerol esters such as glycerol monooleate, borated glycerol esters, fatty phosphites, fatty acid amides, fatty epoxides, borated fatty epoxides, alkoxylated fatty amines, borated alkoxylated fatty amines, metal salts of fatty acids, sulfurized olefins, fatty imidazolines, condensation products of carboxylic acids and polyalkylene-polyamines, amine salts of alkylphosphoric acids, and molybdenum-containing friction modifiers such as molybdenum dithiocarbamates. Among suitable molybdenum friction modifiers are molybdenum and sulfur-containing compositions derived from a molybdenum compound, a basic nitrogen-containing compound, and carbon disulfide. The basic nitrogen compound can be a hydrocarbyl amine or a reaction product of a carboxylic acid with an alkylene polyamine. The molybdenum compound can be an acidic Mo compound such as molybdic acid. An example of such a friction modifier is the reaction product of polyethyleneamine bottoms with isostearic acid, further treated with $MoO_3$ and $H_2O$ and then carbon disulphide.

Other materials which are conventional for use in lubricants may also be included in compositions of the present invention, provided that they are consistent with the use intended for the composition. Typical additives include corrosion inhibitors, friction modifiers, surfactants, oxidation inhibitors such as organomolybdenum compounds for example molybdenum dithiocarbamates and the like, rust inhibitors, viscosity index improvers, pour point depressants, extreme pressure additives, anti-foam agents, anti-stain additives, anti-foulants, and detergents.

For a low ash to no ash engine oil the zinc dialkyldithiophosphates are not employed in the engine oil composition or are at a low level. However, special attention should be paid to the undesirability of introducing ash-forming metals or phosphorus compounds to produce a low ash to no ash engine oil.

In another embodiment the engine oil has a low phosphorous content. The phosphorus content is <0.05%, in one embodiment <0.03%, in another embodiment <0.02%, and in another embodiment <0.01% of phosphorus content in the engine oil. It is preferable that the low phosphorous content be in a low ash engine oil.

In another embodiment the engine oil has a low sulfur content. The sulfur content is generally <0.5, in another embodiment <0.4, are in another embodiment <0.2 in the engine oil. The low sulfur content generally occurs because of the absence of a low level of sulfur containing additives in the engine oil.

In another embodiment the engine oil has a low chlorine content. The chlorine content is <100 ppm, in another embodiment <50 ppm and in another embodiment <20 ppm in the engine oil.

Optionally, an inert carrier can be used if desired. Furthermore, other active ingredients, which provide a beneficial and desired function to the soot being decreased, can be used. In addition, solid, particulate additives such as the PTFE, $MoS_2$ and graphite can also be included.

The engine oil is blended and produced in the same way as conventional engine oil blends, where is known in the art.

Engines

The engines that may be operated in accordance with the invention include all (internal combustion) engines including spark ignited (gasoline) and compression ignited (diesel) for both mobile including locomotive, marine, automotive, truck, heavy duty, aviation and the like, and stationary power plants. The engines may be two-cycle or four-cycle. The engines may employ conventional after treatment devices. Included are on- and off-highway engines, including new engines as well as in-use engines.

In one embodiment of this invention, exhaust after-treatment devices include but are not limited to catalysts particulate traps, NOx traps, exhaust gas recirculation (egr) and the like. The catalysts in the exhaust systems of internal combustion engines convert carbon monoxide, hydrocarbons and nitrogen oxides (NOx) produced during engine operation into more desirable gases such as carbon dioxide, water and nitrogen. Among the broad range of available catalysts for this purpose, are oxidation catalysts, reduction catalysts, the so-called three-way converters and the like.

The exhaust after-treatment device also can use a NOx trap. NOx traps, i.e. materials that are able to absorb nitrogen oxides during lean-burn operation and are able to release them when the oxygen concentration in the exhaust gas is lowered are porous support materials loaded with alkali metal or alkaline earth metals combined with precious metal catalysts such as platinum and the like.

The exhaust after-treatment device also may contain a diesel engine exhaust particulate filter hereinafter referred to as "DPF's". DPF's have a multiplicity of interconnected thin porous walls that allow the gas to pass from the inlet surface to the outlet surface while restraining a desired portion of the solid particulates in the fluid from passing through.

In one embodiment of this invention, the internal combustion engine is equipped with an exhaust after-treatment device. Exhaust after-treatment devices are used for modern engines to meet the new low exhaust emission standards. These systems are used to reduce undesirable emissions in the exhaust gases of internal combustion vehicle engines and are located in the exhaust system connected to the engines.

Specific Embodiment

In order to move thoroughly illustrate the present invention the following examples are provided:

Engine Oil 1. The engine oil (sulfur free, phosphorous free, ashless) that has shown the performance advantage herein described:

| 10W-30, synthetic, poly alpha olefin (PAO) Composition: (These additives are expressed on an oil free basis) | |
|---|---|
| 6.5% | Succinimide dispersant based on direct alkylation (no chlorine) succan from high vinylidene polyisobutylene (PIB) |
| 0.7% | Nonylated diphenyl amine - oxidation inhibitor |
| 0.3% | t-Butylated phenols - hindered phenol type oxidation inhibitor |

Engine Oil 2. The ashless engine oil (sulfur free, low phosphorous, ashless) that has shown the performance advantage herein described:

| % wt. | Composition (These additives are expressed on an oil free basis) |
|---|---|
| 90 | Poly alpha olefin synthetic base stock, 6 cSt SHF/MPC-152 |
| 10 | Other synthetic base stock |
| 0.1 | Styrene-maleic anhydride copolymer, esterfied - pour point depressant |
| 0.7 | Nonylated diphenyl amine - oxidation inhibitor |
| 0.3 | Triphenyl phosphate - antiwear agent |
| 0.3 | t-Butylated phenols - hindered phenol type oxidation inhibitor |
| 6.5 | Succinimide dispersant based on direct alkylation (no chlorine) succan from high vinylidene PIB |
| 0.02 | Pluradyne FL11 - ethylene oxide-propylene oxide copolymer - demulsifier |
| 0.09 | (2-Ethylhexyl/Ethyl) acrylate copolymer - antifoam |

EXAMPLE 1

Preparation of PIB Succinic Acid

A 2300 Mn poly(isobutenyl) succinic anhydride (about 9410 g, about 6.84 eq C═O) was charged to a 12-liter spherical 4-neck flask equipped with a temperature controller regulating a rheostated heating mantle and a thermocouple in a glass thermowell. The material was stirred at about 45° C. and an above-surface $N_2$ sweep was set at about 1 SCFH (standard cubic feet per hour). The mixture was heated to about 90° C. Deionized water (about 184.8 g, about 20.54 equivalents) was then added over about 10 minutes. The mixture was heated at about 90° C. for about 2 hours. Infrared analysis showed acid peak at 1714 cm$^{-1}$ with a slight anhydride or lactone shoulder at 1786 cm$^{-1}$. The mixture was cooled to about 50° C. and discharged.

EXAMPLE 2

Simultaneous Preparation of Both Salts

Oleic acid (about 2450 g), 2-ethyl hexyl nitrate (about 3420 g), and hydrolyzed 2300 molecular weight PIBSA (about 2410 g, about 50% active chemical by weight) (from Example 1) was charged to a 12-liter spherical 4-neck flask equipped with a temperature controller monitoring a thermocouple in a glass thermowell. The mixture was stirred at room temperature under a nitrogen flow at about 1 SCFH, and the materials were mixed until homogeneous. Diethylamino ethanol (about 1110 g) was charged over 1 hour, and a mild exotherm was observed. The resulting material was a solution of carboxylate salts in 2-ethylhexyl nitrate.

Some illustrative water-blended fuel compositions within the scope of the invention are disclosed Table 1. The amounts are in parts by weight.

TABLE I

| Components | Emulsion A | Emulsion B | Emulsion C |
|---|---|---|---|
| Diesel Fuel | 77.80 | 77.51 | 75.30 |
| Water | 20.00 | 20.00 | 16.80 |
| Surfactant 1[1] (~50% active) | 0.526 | 1.16 | 0.526 |
| Surfactant 2[2] | 0.724 | 0.382 | 0.724 |
| 2-ethyl hexyl nitrate | 0.714 | 0.714 | 0.714 |
| Ammonium nitrate | 0.12 | 0.12 | 0.12 |
| Propylene glycol | 0.12 | 0.12 | 0.12 |
| Methanol | 0 | 0 | 5.70 |

[1]This is a biscarboxylate salt that is made by reaction of hydrolyzed 2300 molecular weight PIBSA with diethyl ethanolamine.
[2]This is a carboxylate salt that is made by reacting oleic acid with diethyl ethanolamine.

This is illustrative of concentrates that can be used to make the water-blended fuel compositions of the invention. The numerical values indicated below are parts by weight.

| Components | Concentrate A | Concentrate B |
|---|---|---|
| PIB succinic acid[1] | 21.94 | 41.48 |
| Oleic acid | 22.24 | 10.52 |
| Diethylamino ethanol | 10.11 | 6.95 |
| 2-ethyl hexyl nitrate | 31.04 | 27.049 |
| 54% aqueous ammonium nitrate | 9.66 | 8.56 |
| Propylene glycol | 5.00 | 5.00 |

[1]derived from 2300 molecular weight PIBSA

This demonstrates that the emulsified water-blended fuel compositions using the concentrates disclosed above. In the table below, all numerical values are in parts by weight.

| Components | Emulsion A | Emulsion B |
|---|---|---|
| Diesel Fuel | 79-81 | 79-81 |
| Water | 18-20 | 18-20 |
| Concentrate A | 1.5-3.0 | — |
| Concentrate B | — | 1.5-3.0 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

TABLE I
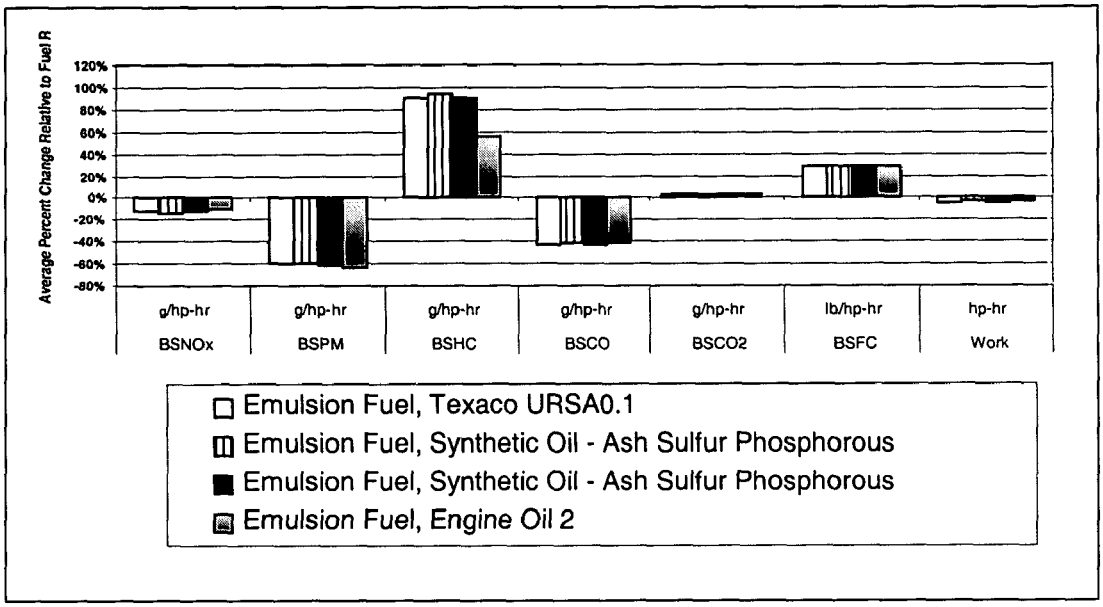

The data from Table I was derived from a 1991 DDC Series 60 engine run over the full FTP cycle. There is a percent reduction relative to the baseline fuel and the same engine oil. No difference in the PM reduction except when using the ashless oil in combination with emulsified fuel. In this case HC went up with the emulsified fuel, however much less in the case of the ashless lubricant.

From the above description and examples the invention those skilled in the art may perceive improvements, changes and modifications in the invention. Such improvement changes and modifications are intended to be covered by the appended claims.

We claim:

1. A combination of a fuel and a lubricant for an internal combustion engine, said fuel and lubricant comprising:

(a) an emulsified fuel comprising (1) water, (2) a fuel and (3) an emulsifier wherein the emulsifier comprises a $C_9$-$C_{11}$ alkoxy poly (ethoxy)$_8$ alcohol; $C_{12}$-$C_{15}$ alkoxy poly (isopropoxy)$_{22-26}$ alcohol; diglycerol monooleate; diglycerol monostearate; polyglycerol monooleate; polyethylene glycol soya bean oil ester; diglycerol dioleate; diglycerol distearate; polyglycerol dioleate; sorbitan monoisostearate; polyethoxy glycerol trioleate; or a mixture of two or more thereof;

(b) at least one lubricant comprising an oil of lubricating viscosity and said lubricant is characterized as having an ash content below 1.0 wt % and as having at least one property selected from the group consisting of:

(i) a phosphorous content of less than 0.05 wt %, (ii) a sulfur content of less than 0.5 wt %, (iii) a chlorine content of less than 100 ppm;

resulting in the reduction of engine emissions selected from the group consisting of particulate matter, NOx, hydrocarbons, soot and combinations thereof.

2. The combination of claim 1 wherein said fuel is selected from the group consisting of gasoline, diesel, kerosene, naphtha, aliphatics, paraffin and combination thereof; non-hydrocarbonaceous materials selected from the group consisting of alcohols, methanol, ethanol, ether, ethanol ether, diethyl ether, methyl ethyl ether, organo-nitro compounds and combinations thereof; fuels derived from vegetable sources selected from the group consisting of corn, alfalfa, shale, coal and combinations thereof; fuels derived from minerals and mixtures thereof; gas to liquid fuels; mixtures of one or more hydrocarbonaceous fuels and one or more non-hydrocarbonaceous materials; and combinations thereof.

3. The combination of claim 1 wherein the lubricant is in a base oil stock selected from the group consisting of, synthetic base oil, poly alpha olefin base oil, mineral oil, at least 50% synthetic base oil, hydrocarbon oil group 1 base stock, hydrocarbon group 2 base stock, hydrocarbon group 3 base stock, hydrocarbon group 4 base stock and combinations thereof.

4. The combination of claim 1 wherein the emulsifier further comprises a mixture of: the reaction product of a fatty acid with an alkanol amine; and the reaction product of a polyisobutene substituted succinic acid or anhydride with an alkanol amine or an alkylene polyamine, the polyisobutene substituent having a number average molecular weight of about 300 to about 3000.

5. The combination of claim 1 wherein the emulsifier further comprises a mixture of: the product made from the reaction of a polyisobutene-substituted succinic acid or anhydride with an alkanol amine wherein the polyisobutene group has a number average molecular weight of about 1500 to about 3000; the product made from the reaction of a hydrocarbon-substituted succinic acid or anhydride with an alkanol amine wherein the hydrocarbon substituent has about 12 to about 30 carbon atoms; and the product made from the reaction of a polyisobutene-substituted succinic acid or anhydride with at least one alkylene polyamine wherein the polyisobutene group has a number average molecular weight of about 750 to about 1500.

6. The combination of claim 1 wherein the emulsifier further comprises (I) a first polycarboxylic acylating agent having at least one hydrocarbon substituent of about 6 to about 500 carbon atoms, (II) a second polycarboxylic acylating agent optionally having at least one hydrocarbon substituent of up to about 500 carbon atoms, the polycarboxylic acylating agents (I) and (II) being the same or different and being linked together by (III) a linking group derived from a compound having two or more primary amino groups, two or more secondary amino groups, at least one primary amino group and at least one secondary amino group, at least two hydroxyl groups, or at least one primary or secondary amino group and at least one hydroxyl group, the polycarboxylic acylating agents (I) and (II) being reacted with ammonia, an amine, a hydroxyamine, an alcohol, water, or a mixture of two or more thereof.

7. The combination of claim 1 wherein the emulsifier further comprises a polyisobutene substituted succinic acid.

8. The combination of claim 1 wherein the emulsifier further comprises an alkylaryl sulfonate, amine oxide, carboxylated alcohol ethoxylate, ethoxylated amine, ethoxylated amide, glycerol ester, glycol ester, imidazoline, lecithin, lecithin derivative, lignin, monoglyceride, monoglyceride derivative, olefin sulfonate, phosphate ester, phosphate ester derivative, propoxylated fatty acid, ethoxylated fatty acid, propoxylated alcohol or alkyl phenol, sucrose ester, sulfonate of dodecyl or tridecyl benzene, naphthalene sulfonate, petroleum sulfonate, tridecyl or dodecyl benzene sulfonic acid, sulfosuccinate, sulfosuccinate derivative, or mixture of two or more thereof, each of these compounds having a hydrocarbon group of at least about 8 carbon atoms.

9. The combination of claim 1 wherein said lubricant is an ashless engine oil comprising at least one dispersant, at least one antioxidant and combinations thereof.

10. The combination of claim 9 wherein the ashless dispersant is selected from the group consisting of at least one of a polyisobutenyl succinimide, high molecular weight succinic esters, Mannich dispersants, carboxylic dispersants, amine dispersants, polymeric dispersants, and combinations thereof; and wherein the antioxidant is selected from the group consisting of 2,6-di-tertiary butyl-4-methyl phenol, phosphosulfurized terpenes, sulfurized esters, diphenyl amines, bis-nonylated diphenylamine, nonyl diphenylamine, octyl diphenylamine, bis-octylated diphenylamine, bis-decylated diphenylamine, diphenylamine, to 2,6-di-tert-butylphenol, 4-ethyl-2,6-di-tert-butylphenol, 4-propyl-2,6-di-tert-butylphenol, 4-butyl-2,6-di-tert-butylphenol 2,6-di-tert-butylphenol, 4-pentyl-2,6-di-tert-butylphenol, 4-hexyl-2,6-di-tert-butylphenol, 4-heptyl-2,6-di-tert-butylphenol, 4-(2-ethylhexyl)-2,6-di-tert-butylphenol, 4-octyl-2,6-di-tert-butylphenol, 4-nonyl-2,6-di-tert-butylphenol, 4-decyl-2,6-di-tert-butylphenol, 4-undecyl-2,6-di-tert-butylphenol, 4-dodecyl-2,6-di-tert-butylphenol, tetra propylene 2,6-di-tert-butylphenol, 4-tridecyl-2,6-di-tert-butylphenol, 4-tetradecyl-2,6-di-tert-butylphenol, methylene-bridged sterically hindered phenols include 4,4'-methylenebis(6-tert-butyl-o-cresol), 4,4'-methylenebis(2-tert-amyl-o-cresol), 2,2'-methylenebis(4-methyl-6-tert-butylphenol), 3,5-di-tert-butyl-4-hydroxy hydrocinnamie, (iso-octyl ester butyl ester), and combinations thereof.

11. The combination of claim 1 wherein said lubricant is characterized as being ash free with an ash content of 0.0 wt %.

12. The combination of claim 1 comprises other lubricant additives selected from the group consisting of viscosity modifiers, functionalized polymers, corrosion inhibitors, rust inhibitors, viscosity index improvers, pour point depressants, extreme pressure additives, antiwear agents, anti-foam agents, anti-stain additives, anti-foulants and combinations thereof wherein the lubricant additives do not add a significant amount of ash forming metals to provide <0.5% sulfur or phosphorus compounds to provide <0.05% phosphorus to the engine oil.

13. An internal combustion engine comprising:

(a) an emulsified fuel comprising (1) water, (2) a fuel and (3) an emulsifier wherein the emulsifier comprises a $C_9$-$C_{11}$ alkoxy poly (ethoxy)$_8$ alcohol; $C_{12}$-$C_{15}$ alkoxy poly (isopropoxy)$_{22-26}$ alcohol; diglycerol monooleate; diglycerol monostearate; polyglycerol monooleate; polyethylene glycol soya bean oil ester; diglycerol dioleate; diglycerol distearate; polyglycerol dioleate; sorbitan monoisostearate; polyethoxy glycerol trioleate; or a mixture of two or more thereof, (b) at least one lubricant comprising an oil of lubricating viscosity and said lubricant is characterized as having an ash content below 1.0 wt % and as having at least one property selected from the group consisting of:

(ii) a phosphorous content of less than 0.05 wt %, (ii) a sulfur content of less than 0.5 wt %, (iii) a chlorine content of less than 100 ppm;

resulting in the reduction of emissions selected from the group comprised in particulate matter, NOx, hydrocarbon, soot in combinations thereof.

14. The internal combustion engine of claim 13 wherein said lubricant is an ashless engine oil comprising at least one dispersant, at least one antioxidant and combinations thereof.

15. An internal combustion engine of claim 13 further comprising an exhaust after-treatment device that traps particulates oxidizes and reduces selected exhaust gas components, or traps and converts NOx to other compounds or said engine is equipped with a system to re-circulate exhaust gases to the intake air supply for said engines.

16. A method for reducing emissions in an engine comprising:

I. operating an engine using (a) an emulsified fuel comprising (1) water, (2) a fuel and (3) an emulsifier wherein the emulsifier comprises: a $C_9$-$C_{11}$ alkoxy poly (ethoxy)$_8$ alcohol; $C_{12}$-$C_{15}$ alkoxy poly (isopropoxy)$_{22-26}$ alcohol; diglycerol monooleate; diglycerol monostearate; polyglycerol monooleate; polyethylene glycol soya bean oil ester; diglycerol dioleate; diglycerol distearate; polyglycerol dioleate; sorbitan monoisostearate; polyethoxy glycerol trioleate; or a mixture of two or more thereof;

(b) at least one lubricant comprising an oil of lubricating viscosity and said lubricant is characterized as having an ash content below 1.0 wt % and as having at least one property selected from the group consisting of:

(i) a phosphorous content of less than 0.05 wt %, (ii) a sulfur content of less than 0.5 wt %, (iii) a chlorine content of less than 100 ppm;

resulting in the reduction of engine emissions selected from the group consisting of particulate matter, NOx, hydrocarbons, soot and combinations thereof.

17. The method of claim 16 further comprising at least one of a lubricant additive selected from the group consisting of anti-foams, viscosity modifiers, functionalized polymers, corrosion inhibitors, rust inhibitors, viscosity index improvers, pour point depressants, extreme pressure additives, anti-foam agents, anti-stain additives, anti-foulants and detergents and combinations thereof wherein the lubricant additives used provide <0.5% sulfur or phosphorus compounds which provide <0.05% phosphorus to the engine oil.

18. The combination of claim 1, wherein the lubricant is ash free having an ash content of 0.0 wt %.

19. The combination of claim 9 wherein the ashless dispersant is selected from the group consisting of at least one of a polyisobutenyl succinimide, high molecular weight succinic esters, Mannich dispersants, carboxylic dispersants, amine dispersants, polymeric dispersants, and combinations thereof; and wherein the antioxidant is selected from the group consisting of 2,6-di-tertiary butyl-4-methyl phenol, 4-propyl-2,6-di-tert-butylphenol, 4-butyl-2,6-di-tert-butylphenol 2,6-di-tert-butylphenol, 4-pentyl-2,6-di-tert-butylphenol, 4-hexyl-2,6-di-tert-butylphenol, 4-heptyl-2,6-di-tert-butylphenol, 4-(2-ethylhexyl)-2,6-di-tert-butylphenol, 4-octyl-2,6-di-tert-butylphenol, 4-nonyl-2,6-di-tert-butylphenol, 4-decyl-2,6-di-tert-butylphenol, 4-undecyl-2,6-di-tert-butylphenol, 4-dodecyl-2,6-di-tert-butylphenol, tetra propylene 2,6-di-tert-butylphenol, 4-tridecyl-2,6-di-tert-butylphenol, 4-tetradecyl-2,6-di-tert-butylphenol, 3,5-di-tert-butyl-4-hydroxy hydrocinnamie, (iso-octyl ester butyl ester), and combinations thereof.

* * * * *